United States Patent [19]

Stenemann

[11] 4,242,173

[45] Dec. 30, 1980

[54] PAVEMENT-MARKING TAPE APPLICATION APPARATUS

[75] Inventor: Heinrich F. Stenemann, Woodbury, Minn.

[73] Assignee: Minnesota Mining and Manufacturing Company, Saint Paul, Minn.

[21] Appl. No.: 79,241

[22] Filed: Sep. 27, 1979

[51] Int. Cl.[3] ..... E04B 2/00; E04F 13/00; B44C 7/00; B44C 7/04

[52] U.S. Cl. ..... 156/523; 156/71; 156/574; 156/577; 404/94

[58] Field of Search ..... 156/523, 576, 71, 391, 156/522, 574, 577; 404/93, 94

[56] References Cited

U.S. PATENT DOCUMENTS

| | | | |
|---|---|---|---|
| 3,007,838 | 11/1961 | Eigenmann | 156/577 |
| 3,393,114 | 7/1968 | Jorgensen | 156/523 |
| 3,551,251 | 1/1974 | Yo Sato et al. | 156/577 |
| 3,871,940 | 3/1975 | Antonioni | 156/523 |
| 3,886,011 | 5/1975 | Eigemann | 404/94 |
| 4,030,958 | 6/1977 | Stenemann | 404/94 |

*Primary Examiner*—John T. Goolkasian
*Assistant Examiner*—L. Falasco
*Attorney, Agent, or Firm*—Cruzan Alexander; Donald M. Sell; Roger R. Tamte

[57] ABSTRACT

Apparatus for applying tape to a paved surface to form markings on the surface, said apparatus being supported for movement along the paved surface by wheel means including at least one roller, and further including tape support means for rotatably supporting a roll of tape; tape guide means positioned above a leading edge of the roller; tape advance means for advancing tape that extends from the roll of tape over the tape guide means into position for the roller to press the tape against the paved surface; and cutting means for cutting the tape while it extends under tension from the roller to the tape guide means.

8 Claims, 9 Drawing Figures

PAVEMENT-MARKING TAPE APPLICATION APPARATUS

The present invention provides apparatus by which pavement-marking tape may be rapidly applied to a paved surface in convenient manual operations.

A previous form of manual pavement-marking tape applicator is described in Jorgensen, U.S. Pat. No. 3,393,114. This apparatus is a scooter-type device with a lever mounted on the upright handle at the forward end of the scooter. One end of the lever is adapted to support a small roll of tape, and pivoting of the lever will bring the free end of tape unwound from the roll into engagement with the paved surface in front of the scooter, where the front wheel of the scooter presses the tape against the paved surface. The other end of the lever carries a cutting blade, which, upon reverse pivoting of the lever, can be pressed against the length of tape extending from the tape roll to the wheel to sever the tape, thereby ending application of tape to the paved surface.

The described apparatus is designed only for short-length striping, since only a small roll of tape can be supported and handled on the apparatus. Also, propelling a scooter while at the same time operating the application lever is difficult to coordinate. Although the apparatus may be useful for specialized purposes, it is no answer to the need for apparatus capable of applying extensive lengths of tape as traffic-control stripes on a roadway by convenient manual operations; nor does any other known apparatus meet that need.

SUMMARY OF THE INVENTION

In brief summary, application apparatus of the present invention comprises a frame supported for movement along the paved surface by wheel means including at least one roller, and mounted on the frame:

tape support means for rotatably supporting a roll of tape;

tape guide means positioned above a leading edge of the roller;

tape advance means for advancing tape that extends from the roll of tape over the tape guide means into position for the roller to press the tape against the paved surface; and cutting means for cutting the tape while it extends under tension from the roller to the tape guide means.

Preferably the tape advance means comprises a tape advance lever pivotable between an initial position near the tape guide means and an advance position near the leading edge of the roller; and tape gripping means attached to the tape advance lever and including a portion through which tape passed over the tape guide means may be inserted, said gripping means being operable during movement of the tape advance lever from the initial position to the advance position to grip the inserted tape and advance it toward the paved surface. The free end of tape is thereby advanced into contact with the paved surface in front of the roller, where it drags on the paved surface during forward movement of the apparatus, is engaged by the roller, and is pressed against the paved surface.

Quite often, two rolls of tape are rotatably supported side-by-side on the frame, and lengths of tape are unwound from both rolls and applied as parallel markings. The cutting means preferably is formed so as to allow cutting of either length of tape without cutting the other length. Such a preferred form of cutting means comprises two arms mounted one on each of the two sides of said frame; a knife blade extending between the forward ends of the arms and across the lengths of tape that extend from the tape guide means to the roller; and actuating means for pulling one of the arms ahead of the other and then pulling both arms together. In this way the knife blade may be tilted toward one of the lengths of tape and then moved through the lengths of tape one after the other, so that the cutting operation may be interrupted after one length of tape has been cut.

DESCRIPTION OF THE DRAWINGS

The drawings show a representative application apparatus of the invention.

DETAILED DESCRIPTION

Figure 1:
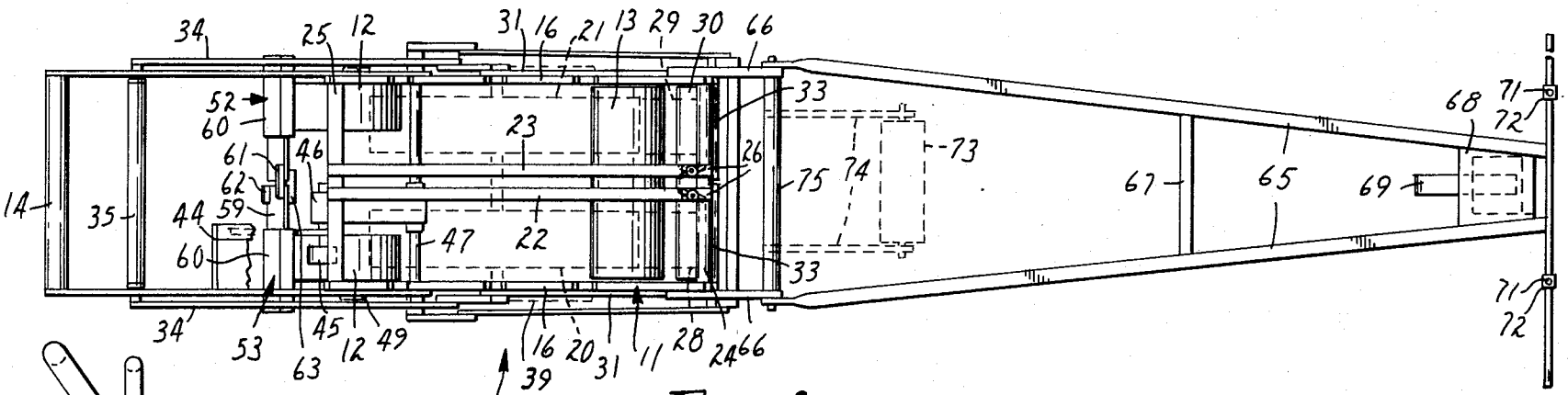
FIG. 1 is a plan view of the apparatus.
Figure 2:
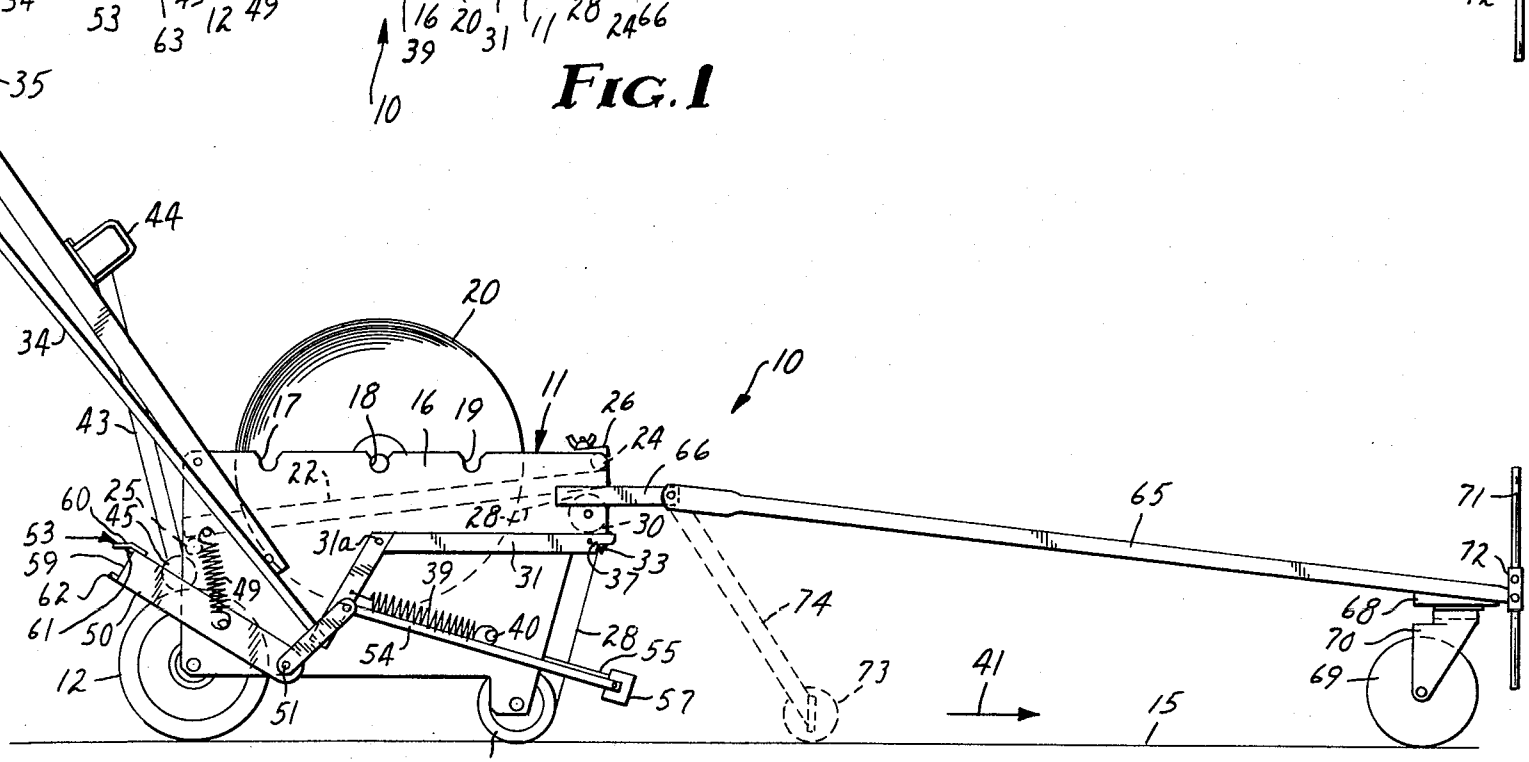
FIG. 2 is a side elevation view of the apparatus.

As shown in FIGS. 1 and 2, a representative application apparatus of the invention 10 comprises a frame 11 supported on back wheels 12 and a front roller or wheel 13. A handle 14 is attached to the frame 11, by which an operator can manually push the apparatus 10 along a paved surface 15. The frame 11 includes two side panels 16 which each have grooves 17, 18, and 19 formed in their top edge in which a shaft carrying a roll of tape may be supported. In some cases the forward grooves 19 support rolls from which tape is initially unwound, and the back grooves 17 support secondary rolls which supply tape when the initial rolls are exhausted.

In a typical use of the apparatus 10, two rolls of tape, 20 and 21, shown in phantom in FIG. 1, are supported on a shaft side-by-side, so as to allow application of parallel, closely spaced stripes. Bars 22 and 23 are supported on cross members 24 and 25 and may be clamped in position with clamps 26 so as to confine the rolls in a desired location transversely on the frame.

Lengths of tape 28 and 29 unwound from the rolls 20 and 21 pass over a tape guide roller 30, which is positioned above the leading edge of the roller 13. A tape advance means is provided to pull tape unwound from the rolls over the roller 30 and advance it toward the paved surface. The tape advance means comprises forked tape advance levers 31 pivoted on each side of the frame panels 16 at 31*a*; a first gripping plate 32 and a pair of pivotable gripping plates 33 mounted side-by-side between the forward ends of the two tape advance levers, one plate 33 for each length of tape 28 and 29; rods 34 attached to the other end of the tape advance levers; and an actuating handle 35 pivotably attached to the rods 34 and the apparatus handle 14. Upon movement of the actuating handle from the position shown in FIG. 2 to the position shown in FIG. 3, the tape advance levers are pivoted, with the forward ends of the levers moving from an initial position near the tape guide roller 30 to an advance position near the leading edge of the roller 13.

Figure 3:
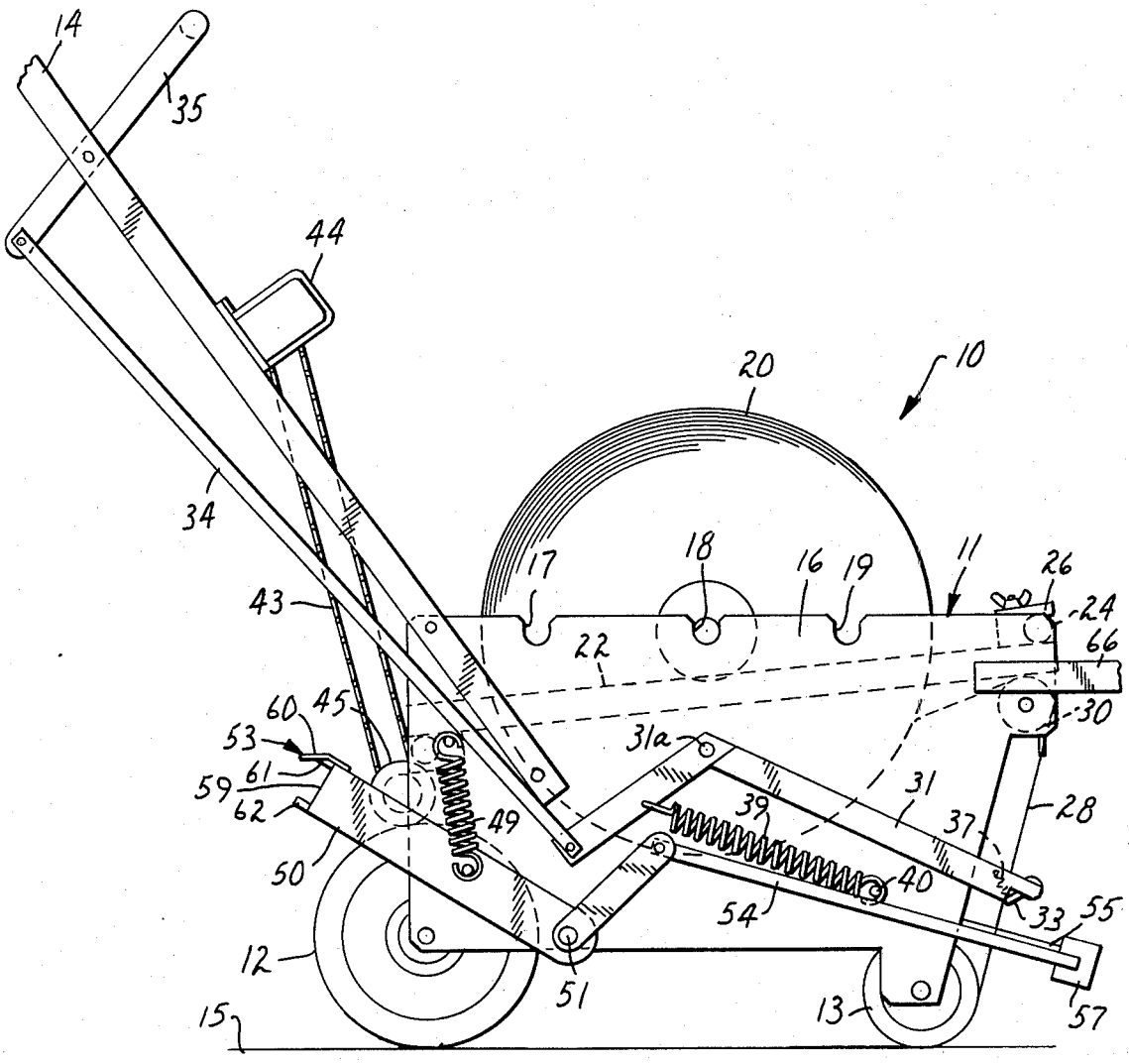
FIGS. 3 and 4 are enlarged side elevations of portions of the apparatus, showing those portions at different stages of operation.
Figure 5:
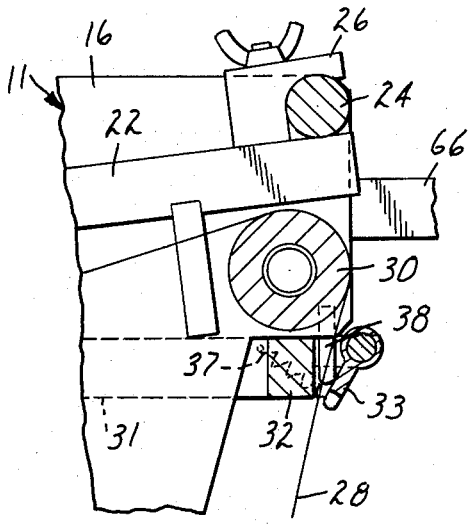
FIGS. 5–8 are enlarged views of different portions of the apparatus at different stages of operation, FIGS. 5 and 6 showing a tape-gripping apparatus, and FIGS. 7 and 8, which are partially in section, showing a tape-cutting apparatus.
Figure 6:
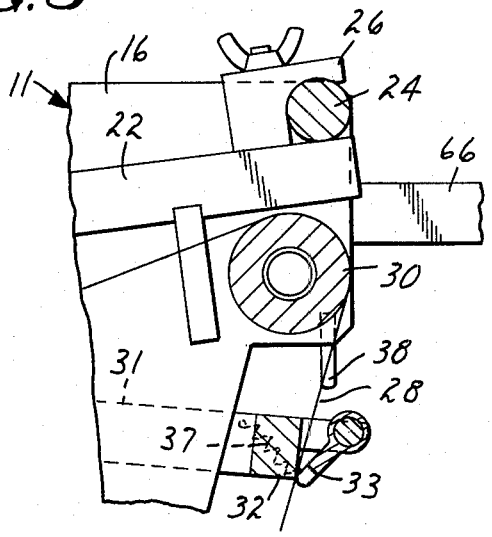
Figure 4:
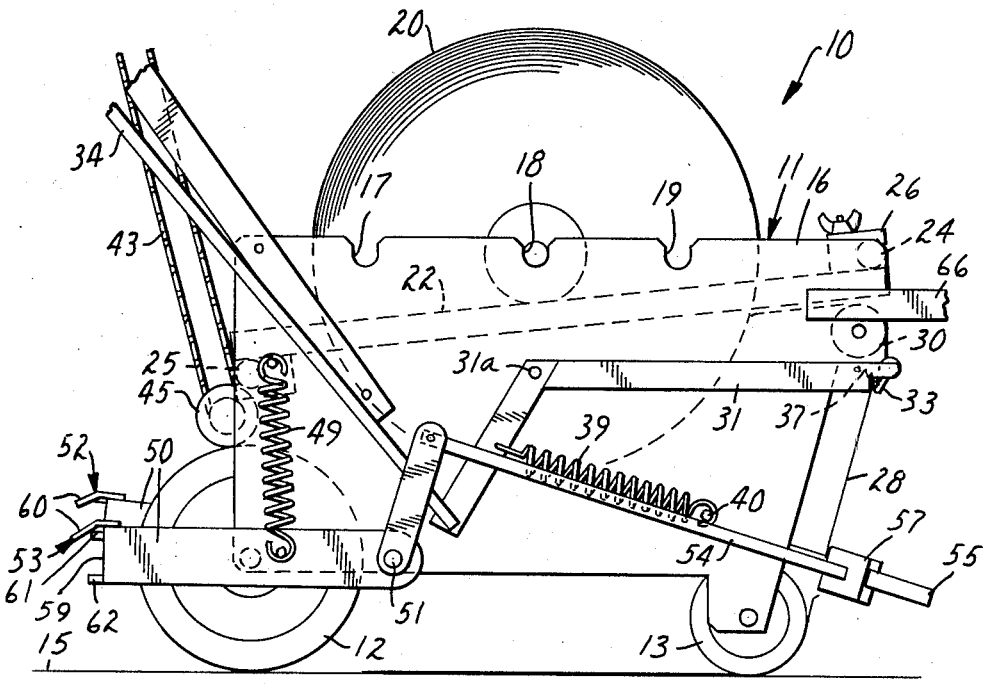
Figure 7:
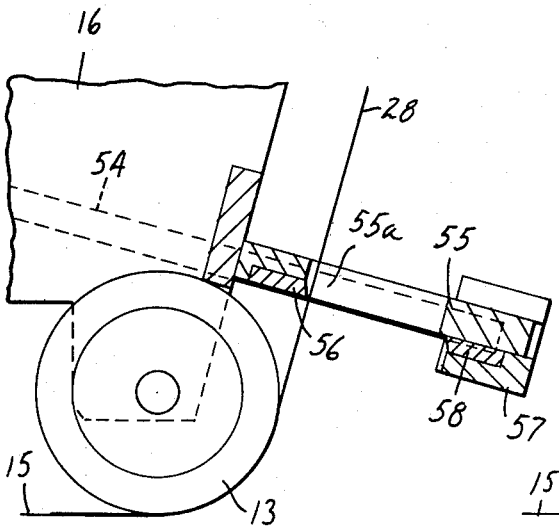
Figure 8:
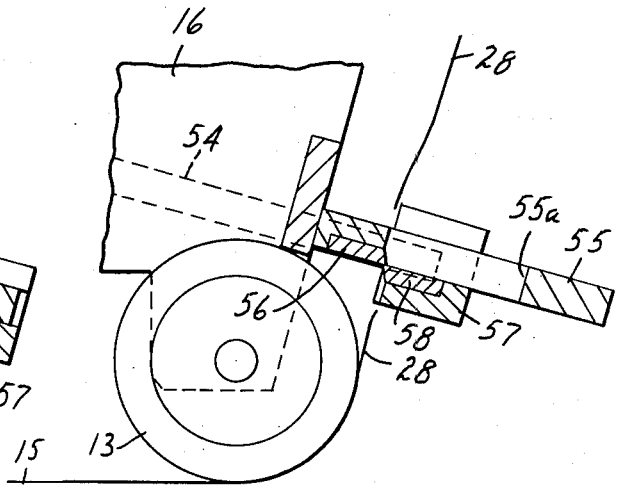

The pivotable gripping plates 33 are biased toward the gripping plate 32 by springs 37 (see FIGS. 2 and 3). However, as shown in FIG. 5, when the tape advance levers are in their rest position, posts 38 projecting downwardly from the frame side panels 16 engage the gripping plates 33 to hold them away from the first gripping plate 32. The lengths of tape 28 and 29 passed over the tape guide roller 30 thus may be threaded between the gripping plates 32 and 33. Upon movement of the tape advance levers 31 away from their rest position, the pivotable gripping plates 33 are moved away from the projecting posts 38, whereupon the springs 37 pull the plates into frictional contact with the lengths of tape 28 and 29. Continued pivotal movement of the tape advance levers 31 will move the lengths of tape 28 and 29 toward the paved surface.

After an operator releases pressure on the actuating handle 35, springs 39 connected between posts 40 on the frame side panels 16 and the tape advance levers 31 pull the levers back to their rest position. The lengths of tape 28 and 29 tend to slide between the gripping plates during this return movement of the tape advance levers, since the pivotable gripping plate slants in the direction of the relative movement between it and the tape. In any event, when the tape advance levers reach their rest position, the posts 38 engage the gripping plates 33 and push them away from the tape.

Upon initial threading of the lengths of tape 28 and 29 between the gripping plates 32 and 33, the free ends of the tape can be left spaced above the paved surface, and movement of the tape advance levers 31 to their advance position will move the free ends of the tape into contact with the paved surface in front of the roller 13. During forward movement of the application apparatus 10 in the direction of the arrow 41, the tape drags on the paved surface and the roller 13 passes over it. The roller presses the lengths of tape against the paved surface and pulls additional tape over the tape guide roller 30 and from the rolls 20 and 21. The tape carries adhesive, or adhesive has been applied to the paved surface, whereby the lengths of tape adhere to the paved surface.

The length of tape applied during forward movement of the application apparatus may be measured with a counting apparatus, which includes a chain 43 extending between a counter 44 and a gear, which is not shown but is fixed on the same shaft as a roller 45. The shaft is mounted on a plate 46 which is pivotably attached to cross member 47 of the frame 11, and a spring (not shown) pulls the plate downwardly so as to press the roller 45 into frictional engagement with one of the back wheels 12. The counter 44 displays the distance traveled, and can provide a signal advising an operator when a desired length of tape has been applied.

After a desired length of tape has been applied, the tape is cut with a cutting means, which includes forked actuating levers 50 pivoted on extensions 51 of the cross member 47; foot pedals 52 and 53 mounted on one end of the actuating levers; arms 54 attached to the other end of the actuating levers; a support plate 55 with an opening **55*a* through which pass the lengths of tape extending from the tape guide roller 30 to the roller 13; a knife blade 56 attached to the support plate 55 along one edge of the opening 55*a*; grooved blocks 57 slidably supported on the support plate 55; and a knife blade 58 extending between the two blocks 57. The foot pedals 52 and 53 each comprise a base plate 59 and a cross plate 60 attached at the top of the base plate. Downward movement of the pedal 52 carries a projection 61 extending from the top of the pedal 52 into contact with a projection 62 at the bottom of pedal 53, after which both pedals move together. Similarly a projection 63 on pedal 53 will engage a projection (not shown) on pedal 52**.

Figure 9:
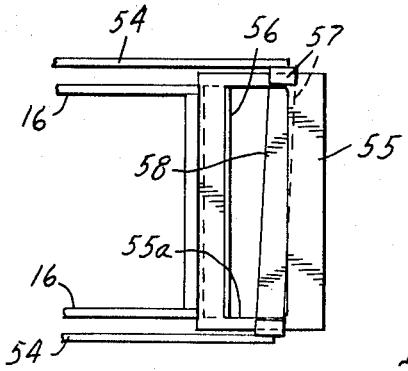
FIG. 9 is a top view of a portion of the tape-cutting apparatus.

During the initial downward movement of a foot pedal, the actuating lever 50 on which that pedal is mounted is pivoted, which thereby pulls one of the arms 54. The connection between the knife blade 58 and the grooved blocks 57 is sufficiently loose so that pulling movement of only one of the arms 54 will move only the end of the blade 58 to which the arm is attached. See FIG. 9, which shows tilting of the knife blade caused by pressure on the pedal 53. Continued downward pressure on a pedal after the initial tilting of the knife blade causes the projection on the pressed pedal to engage the projection on the other pedal, whereupon both pedals move together. Thereupon both arms 54 are pulled, and the tilted knife blade 58 is moved in translatory movement past the knife blade 56 to cut the lengths of tape extending through the opening **55*a*. After one length of tape has been cut, the operator may release pressure on the foot pedal, thereby leaving the other length of tape uncut. A full downward stroke of the pedal causes cutting of both lengths of tape. Springs 49** return the pedals to their initial position.

After the cutting operation, a new cycle of operation may be begun by operation of the tape advance levers 31 to advance the cut end of the tape into contact with the paved surface. If only one length of tape has been cut, the tape advance levers should be operated while the apparatus is moving forward, which causes the uncut length of tape to be drawn in the same direction as the tape advance levers are being moved.

A boom assembly 64 is attached at the front of the frame to assist an operator to guide the apparatus. The assembly 64 includes longitudinal members 65 pivotably attached to plates 66 protruding from the frame side panels 16, a reinforcing member 67, a mounting plate 68 at the forward end of the assembly, and a wheel 69 rotatably supported on a vertical bracket 70 which is pivotably mounted on the plate 68. Guide rods 71 are mounted on the front of the assembly and may be adjusted by loosening of threaded studs in the blocks 72 to allow positioning of especially the vertical rod **71*a*** over a desired guide mark.

A tape-removal roller 73 may be connected to the front of the application apparatus 10 by arms 74 pivotably attached to a cross member 75 extending between the plates 66. If it is desired to remove tape from a roadway, one end of the tape can be lifted and wrapped around the roller so as to become overlapped on the roller. The apparatus can then be pushed forward and the applied tape wraps around the wheel and is removed.

What we claim is:

1. Apparatus for applying tape to a paved surface to form markings on the surface, said apparatus comprising a frame supported for movement along the paved surface by wheel means including at least one roller, and mounted on the frame:

tape support means for rotatably supporting a roll of tape;

tape guide means positioned above a leading edge of said roller;

a tape advance lever pivotable between an initial position near said tape guide means and an advance position near the leading edge of said roller;

actuating means mounted at the rear of the apparatus for moving the tape advance lever from the initial position to the advance position;

tape gripping means attached to the tape advance lever and including a portion through which tape passed over the tape guide means may be inserted, said gripping means being operable to grip the inserted tape during movement of the tape advance lever from the initial position to the advance position and thereby advance the tape toward the paved surface, to the effect that the free end of tape is advanced into contact with the paved surface in front of the roller, drags on the paved surface during forward movement of the apparatus, is engaged by the roller, and is pressed against the paved surface; and cutting means for cutting the tape while it extends under tension from the tape guide means to the roller.

2. Apparatus of claim 1 in which the tape gripping means comprises a first gripping plate, a second pivotable gripping plate biased toward the first gripping plate; and holding means holding the first and second gripping plates in spaced relationship when the tape advance lever is in the initial position; the space gripping plates defining a slot through which tape passed over the tape guide means may be inserted; the second gripping plate being released from the holding means at the beginning of movement of the tape advance lever from the initial position to the advance position to allow movement toward the first gripping plate to grip the inserted length of tape.

3. Apparatus of claim 2 in which the holding means comprises a post which the second gripping plate engages during movement of the tape advance lever to the initial position, which pushes said gripping plate away from the first gripping plate.

4. Apparatus of claim 1 in which the cutter means includes two arms mounted one on each of the two sides of the frame, a knife blade extending between the forward ends of the arms, and actuating means for pulling on the arms to draw the knife blade through the tape extending between the tape guide means and roller.

5. Apparatus of claim 4 in which the tape support means includes means for rotatably supporting two rolls of tape side-by-side, whereby tape may be unwound from each roll and drawn over the tape guide means to a leading edge of the roller, and the knife blade of the cutter means extends across both lengths of tape but may be tilted toward one of the lengths of tape prior to translation of the knife blade toward the tape so as to cut one length of tape prior to cutting the other length.

6. Apparatus of claim 5 in which each of the arms is connected to an actuating pedal and each pedal has a projection that engages a projection on the other pedal during movement of the first pedal, initial movement of the first pedal causing the stated tilting of the knife blade, and movement of both pedals after engagement of the projections causing translation of the knife blade against the tape.

7. Apparatus for applying tape to a paved surface to form markings on the surface, said apparatus comprising a frame supported for movement along the paved surface by wheel means including at least one roller, and mounted on the frame:

tape support means for rotatably supporting at least two rolls of tape side-by-side;

tape guide means positioned above a leading edge of the roller;

tape advance means for advancing tape that extends from the rolls of tape over the tape guide means into position for the roller to press the tape against the paved surface; and cutting means for cutting the tape while it extends under tension from the tape guide means to the roller, the cutting means comprising two arms mounted one on each of the two sides of the frame, a knife blade extending between the forward ends of the arms and across the lengths of tape that extend from the tape guide means to the roller; and actuating means for pulling one of the arms ahead of the other, whereby the knife blade may be tilted toward one of the lengths of tape prior to movement through the lengths of tape so as to cut one length prior to cutting the other length.

8. Apparatus of claim 7 in which the cutting means includes two pedals, one being connected to each arm, and the pedals each have a member that extends into the path of movement of a member on the other pedal such that after a predetermined actuating movement of one pedal to cause the stated tilting of the knife blade, the second pedal is caused to move, thereby moving both arms together and drawing the knife blade through one length of tape and then by continued pressure on the pedals through the other length of tape.

* * * * *